US005508726A

United States Patent [19]

Sugahara

[11] Patent Number: 5,508,726

[45] Date of Patent: Apr. 16, 1996

[54] INK JET APPARATUS

[75] Inventor: Hiroto Sugahara, Aichi, Japan

[73] Assignee: Brother Kogyo Kabushiki Kaisha, Nagoya, Japan

[21] Appl. No.: 155,850

[22] Filed: Nov. 23, 1993

[30] Foreign Application Priority Data

Jan. 27, 1993 [JP] Japan ..... 5-011406

[51] Int. Cl.[6] ..... B41J 2/045

[52] U.S. Cl. ..... 347/68

[58] Field of Search ..... 347/68, 69, 45, 347/65, 20; 310/328, 333, 357, 358; 29/25.35

[56] References Cited

U.S. PATENT DOCUMENTS

| | | | |
|---|---|---|---|
| 4,499,480 | 2/1985 | Takatori et al. | 347/45 X |
| 4,786,357 | 11/1988 | Campanelli et al. | 347/63 X |
| 4,879,568 | 11/1989 | Bartky et al. | 347/69 |
| 4,887,100 | 12/1989 | Michaelis et al. | 347/69 |
| 5,016,028 | 5/1991 | Temple | 347/69 |
| 5,248,998 | 9/1993 | Ochiai et al. | 347/69 |
| 5,252,994 | 10/1993 | Narita et al. | 347/71 |
| 5,301,404 | 4/1994 | Ochiai et al. | 29/25.35 |

FOREIGN PATENT DOCUMENTS

| | | | |
|---|---|---|---|
| 0364136A3 | 4/1990 | European Pat. Off. | B41J 2/045 |
| 0484983A2 | 5/1992 | European Pat. Off. | B41J 2/045 |
| 0538842A2 | 4/1993 | European Pat. Off. . | |
| 0580283A2 | 1/1994 | European Pat. Off. | B41J 2/045 |
| 3266645 | 11/1991 | Japan | B41J 2/045 |
| 4158044 | 6/1992 | Japan | B41J 2/045 |
| 4282254 | 10/1992 | Japan | B41J 2/045 |
| 5016355 | 1/1993 | Japan | B41J 2/045 |
| 5-50606 | 3/1993 | Japan . | |
| WO92/22429 | 12/1992 | WIPO | B41J 2/045 |

*Primary Examiner*—Benjamin R. Fuller
*Assistant Examiner*—Alrick Bobb
*Attorney, Agent, or Firm*—Oliff & Berridge

[57] ABSTRACT

An ink jet apparatus has a piezoelectric ceramic arrangement including a plurality of grooves filled with ink. The grooves are separated from one another by side walls, and the inside of the grooves are partially furnished with electrodes. The electrodes receive a driving voltage to selectively vary the inner volumes of the grooves based on the piezoelectric thickness slip effect. The selectively varied inner volumes of the grooves cause the ink to jet out therefrom. In this structure, the height of the side walls divided by the width thereof is at least 2 and at most 9. Using a low driving voltage, the apparatus boosts the ink pressure within the ink chambers so as to keep the velocity of jetted ink droplets sufficiently high and the volume thereof sufficiently large to form characters and images onto a printing medium.

42 Claims, 9 Drawing Sheets

INK JET APPARATUS

BACKGROUND OF THE INVENTION

1. Field of the Invention

The present invention relates to an ink jet apparatus and, more particularly, to an ink jet apparatus that operates by the deformation of piezoelectric ceramics.

2. Description of the Related Art

Known ink jet printer heads operate on the so-called drop-on-demand method utilizing a piezoelectric ceramic arrangement. This type of ink jet printer head involves having the piezoelectric ceramic arrangement deformed to vary the volumes of ink chambers formed therein. When the volume of a given ink chamber is reduced, the ink inside that ink chamber is jetted out through a nozzle in the form of droplets; when the volume of an ink chamber is expanded, additional ink is introduced into that ink chamber through a separately provided ink conduit. A large number of such ink chambers are positioned close to one another. The nozzles coupled to the ink chambers jet out ink droplets selectively according to appropriate print data. The process forms characters or images onto paper or other suitable medium positioned opposite to the nozzles.

Typical ink jet apparatuses of this kind are disclosed illustratively in U.S. Pat. Nos. 4,879,568, 4,887,100 and 5,016,028. FIGS. 15, 16, 17 and 18 outline these apparatuses. A typical constitution of this kind of ink jet apparatus is described referring to FIG. 15 which is a cross-sectional view of the prior art apparatus. In FIG. 15, a piezoelectric ceramic plate I comprises a plurality of grooves 15 and side walls 11 that separate the grooves 15. The ceramic plate 1 is polarized in the direction of arrow 4. A cover plate 2 is made of ceramic or plastic resin. The piezoelectric ceramic plate 1 and the cover plate 2 are bonded together with a junction layer 3 interposed therebetween. The junction layer 3 is composed of epoxy resin adhesive or the like. In this structure, the grooves 15 form a plurality of ink chambers 12 spaced apart crosswise. Each ink chamber 12 has a rectangular cross section and is long and narrow in shape. Each side wall 11 extends along the entire length of the ink chamber. Both sides of each wall 11 from the wall top near the junction layer 3 to the approximate middle of the wall are furnished with metal electrodes 13 that apply driving electric fields. All ink chambers 12 are filled with ink during operation.

The operation of the above ink jet apparatus is described referring to FIG. 16, which is another cross-sectional view of the prior art apparatus. In operation, an ink chamber **12*b* is illustratively selected according to the print data supplied. Then metal electrodes 13*e* and 13*f* rapidly apply a positive driving voltage, while metal electrodes 13*d* and 13*g* are connected to ground. This causes a driving electric field to develop on a side wall 11*b* in the direction of arrow 14*b* and another driving electric field to develop on a side wall 11*c* in the direction of arrow 14*c*. Because the directions of the driving fields 14*b* and 14*c* are each perpendicular to the direction of polarization 4, the side walls 11*b* and 11*c* are deformed rapidly into the ink chamber 12*b* due to the so-called piezoelectric thickness slip effect. The deformation reduces the volume of the ink chamber 12*b* and rapidly raises the ink pressure therein, generating pressure waves that cause ink droplets to jet out of a nozzle (FIG. 17) connected to the ink chamber 12*b*. When the driving voltage is gradually deactivated, the side walls 11*b* and 11*c* return to their initial positions. This gradually reduces the ink pressure inside the ink chamber 12*b*, introducing ink thereinto through an ink supply port 21 and a manifold 22 (FIG. 17**).

Only the basic operation of the prior art apparatus is described above. When incorporated in specific printers, the ink jet apparatus may work in a somewhat different manner. That is, the driving voltage may be applied initially in a direction that will increase the volume of the ink chamber **12*b*** to fill it with ink, followed by the deformation of the side walls to jet the ink out.

The construction and manufacture of the prior art apparatus is described illustratively with reference to FIG. 17, which is an exploded view in partial section. The piezoelectric ceramic plate 1 is first polarized and then cut by a thin disc-shaped diamond blade tool or the like to form the grooves 15 arranged in parallel. The grooves 15 form the ink chambers 12 as mentioned above. While the parallel grooves 15 have substantially the same depth over the entire area of the piezoelectric ceramic plate 1, the grooves become somewhat shallower as they approach a plate edge 17. Near the edge 17, the grooves 15 are replaced by shallow grooves 18 also arranged in parallel. The inner surfaces of the parallel grooves 15 and 18 are furnished with the metal electrodes 13. The electrodes are deposited on the wall surfaces by sputtering or by other suitable processes. While only the upper half of the side walls of the grooves 15 is equipped with the metal electrodes 13, the entire side walls and the bottoms of the shallow parallel grooves 18 are covered with the metal electrodes. Furthermore, ink supply ports 21 and manifolds 22 are ground or cut through the cover plate 2 made of ceramic or plastic resin.

The groove-cut side of the piezoelectric ceramic plate 1 and the manifold-formed side of the cover plate 2 are bonded together, preferably using epoxy resin adhesive or the like. The two plates are bonded so that the ink chambers 12 of the above-mentioned shape will be formed therebetween. The outer edge 16 of the piezoelectric ceramic plate 1 and the outer edge of the cover plate 2 are bonded to a nozzle plate 31. The nozzle plate 31 has nozzles 32 corresponding to the positions of the ink chambers 12. A substrate 41 is bonded to the surface opposite to the groove-cut side of the piezoelectric ceramic plate 1 by epoxy resin adhesive or the like. The substrate 41 has conductive layer patterns 42 corresponding to the positions of the ink chambers 12. The metal electrodes at the bottoms of the shallow parallel grooves 18 are connected to the conductive layer patterns 42 by use of conductors 43 deposited by wire bonding.

The construction of the control section of the prior art apparatus is described with reference to FIG. 18, which is a schematic diagram of the control section. Each of the conductive layer patterns 42 on the substrate 41 is connected individually to an LSI chip 51. Also connected to the LSI chip 51 are a clock line 52, a data line 53, a voltage line 54 and a grounding line 55. Given continuous clock pulses through the clock line 52, as well as data from the data line 53, the LSI chip 51 decides through which nozzles ink droplets are to be jetted out. Based on its decision, the LSI chip 51 selectively applies the voltage V of the voltage line 54 to the conductive layer patterns 42 connected to the metal electrodes that belong to the target ink chambers. The LSI chip 51 also applies a zero voltage of the grounding line 55 to those conductive layer patterns connected to the metal electrodes that do not belong to the target ink chambers.

One disadvantage of the above-described prior art ink jet apparatus is a low ink pressure that occurs inside the ink chambers. This is attributable to the fact that the side walls made of piezoelectric ceramics are not deformed appreciably despite high levels of electric energy applied to the metal electrodes. The comparatively limited reductions in the volumes of the ink chambers result in the low ink pressure therein. The available ink pressure is not enough to ensure a sufficiently high velocity and a sufficiently large volume of ink droplets jetted onto paper or like material to form characters and images successfully on the paper positioned opposite to the printer head. If the prior art apparatus is desired to jet ink droplets at velocities and in volumes sufficient for the formation of characters and images, the apparatus is required to handle high driving voltages. To meet this requirement, a complicated large-size driving circuit must be built that puts severe constraints on any costs containing and size reduction efforts.

SUMMARY OF THE INVENTION

It is therefore a primary object of the present invention to overcome the above and other deficiencies and disadvantages of the prior art and to provide an ink jet apparatus capable of jetting ink droplets at a sufficient velocity and in a sufficient volume to form characters and images onto an appropriate medium with a low driving voltage.

In carrying out the invention and according to one aspect thereof, an ink jet apparatus is provided having a piezoelectric ceramic arrangement including a plurality of grooves filled with ink. The grooves are separated from one another by side walls, and the inside of the grooves are partially furnished with electrodes. The electrodes receive a driving voltage to selectively vary the inner volumes of the grooves based on the piezoelectric thickness slip effect. The selectively varied inner volumes of the grooves cause the ink to jet out therefrom, wherein the height of the side walls divided by the width thereof is at least 2 and at most 9.

According to another aspect of the invention, an ink jet apparatus is provided continuous grooves forming ink chambers that have substantially the same depth and curvature of at least 5 millimeters.

According to a further aspect of the invention, an ink jet apparatus is provided with grooves forming ink chambers that have depths varying in a linearly gradual manner, and wherein the bottoms of the grooves with the varying depths have an absolute taper value of 0.02 at most.

According to an even further aspect of the invention, an ink jet apparatus is provided with grooves having side walls, wherein the taper value T of the side walls is at most 0.16 from the expression $$T=|Bl-Bu|/H$$

where, H stands for the height of the side walls, Bu for the top width thereof and Bl for the bottom width thereof.

According to a still further aspect of the invention, an ink jet apparatus is provided having grooves filled with ink separated from one another by side walls, wherein the width B of the side walls divided by the pitch Z thereof (B/Z) is at least 0.2 and at most 0.9.

According to another aspect of the invention, an ink jet apparatus is provided having a plurality of grooves filled with ink separated from one another by side walls, wherein the curvature of the bottom of the side walls is at least 5 μm.

According to a further aspect of the invention, there is provided an ink jet apparatus having a plurality of grooves filled with ink separated from one another by side walls, wherein the direction of the height of the side walls is at an angle of 18 degrees at most relative to the direction of polarization of the side walls.

According to a still further aspect of the invention, an ink jet apparatus is provided having a plurality of grooves filled with ink separated from one another by side walls, wherein the surface roughness Rz of the side walls is 6.5 μm at most.

In operation, the ink pressure generated within the grooves is made significantly higher in the following cases: when the height of the side walls divided by the width thereof is at least 2 and at most 9; when the taper value T of the side walls is at most 0.16; when the width of the side walls divided by the pitch thereof is at least 0.2 and at most 0.9; or when the direction of the height of the side walls is at an angle of 18 degrees at most relative to the direction of polarization of the side walls. The velocity at which ink droplets are jetted out is made appreciably higher when the curvature of the grooves is at least 5 millimeters, when the bottoms of the grooves having the linearly varying depths have an absolute taper value of 0.02 at most, or when the surface roughness of the side walls is 6.5 μm at most. Where the curvature of the bottoms of the side walls is at least 5 μm, the jetting of ink droplets is not stopped inadvertently, whereby the reliability of the apparatus is boosted.

These and other objects, features and advantages of the invention will become more apparent upon a reading of the following description and appended drawings.

DESCRIPTION OF PREFERRED EMBODIMENTS

Figure 1:
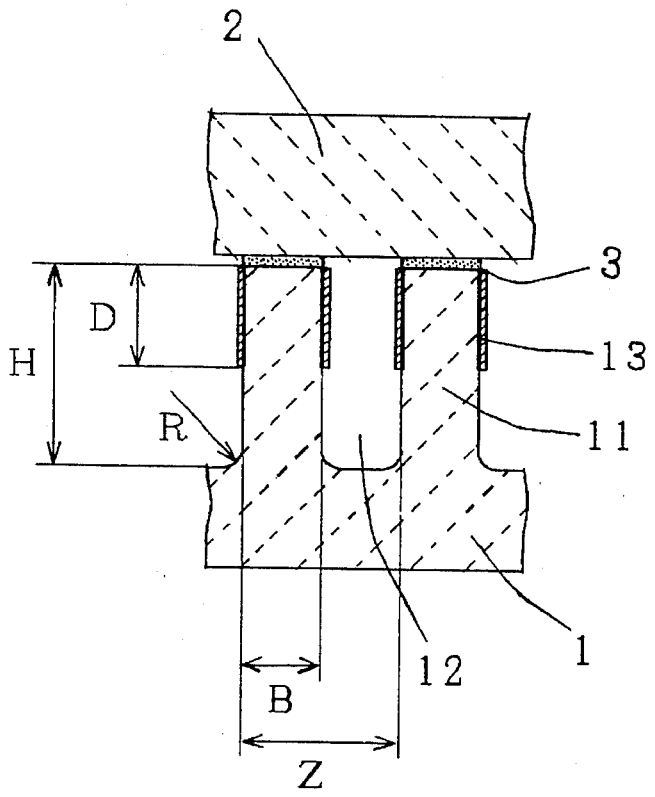
FIG. 1 is an enlarged partial cross-sectional view of an ink jet apparatus in a preferred embodiment of the invention.

Preferred embodiments of the invention are described referring to the accompanying drawings. In describing the embodiments, the parts the same as or corresponding to those in the prior art apparatus are designated by the same reference numerals, and any repetitive description thereof is omitted.

I. The relationship between the ratio of side wall height to side wall width (H/B) and the pressure P inside ink chambers The parameters representing the shapes of side walls 11 and metal electrodes 13 are described referring to FIG. 1. In FIG. 1, H stands for the height of the side walls 11 provided on the piezoelectric ceramic plate 1, B stands for the width of the side walls 11, Z stands for the pitch of the side walls 11 (wherein the pitch, also known as the frequency of the side walls, is the sum of the wall width and the groove width as shown in FIG. 1.), R stands for the curvature of the side wall bottoms, and D stands for the distance from top to bottom of the metal electrodes 13 formed on the surfaces of the side walls 11.

Figure 2:
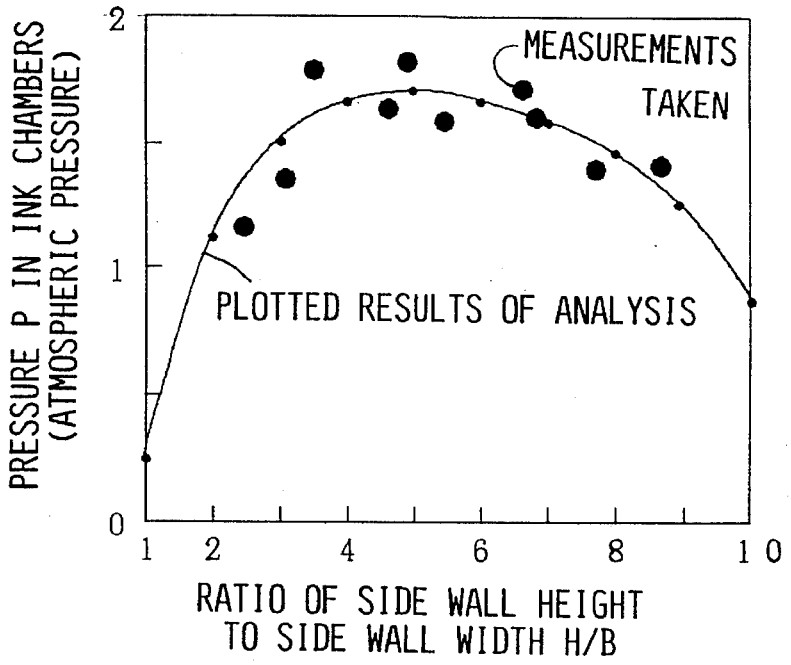
FIG. 2 is a graph showing typical relations between the ratio of side wall height to side wall width (H/B) on the one hand, and the pressure P inside ink chambers on the other in the invention.

FIG. 2 shows typical relations between the ratio of side wall height to side wall width (H/B) on the one hand, and the pressure P inside ink chambers on the other. In developing this invention, the inventor produced an ink jet apparatus wherein the ratio of side wall height to side wall width (H/B) was varied. With this apparatus set to varying H/B ratios, the same driving voltage was applied to the metal electrodes 13, and the pressure levels generated accordingly in the ink chambers 12 were measured. The width B of each side wall 11 of the ink jet apparatus ranged from 40 μm to 120 μm, and the height thereof ranged from 100 μm to 600 μm. The length D of the metal electrodes 13 was set to about half the height H of the side walls 11. The piezoelectric ceramic plate 1 was composed of barium titanate piezoelectric ceramics. The metal electrodes 13 were made of an aluminum layer about 1 μm thick and formed by vacuum evaporation. The cover plate 2 was made of borosilicate glass, and the junction layer 3 of epoxy resin adhesive. The ink used was tripropylene glycol monomethyl ether (TPM)-based pigment ink. The driving voltage applied to the metal electrodes 13 was 40 volts.

The pressure inside the ink chambers was measured as follows. From above the transparent cover plate 2, parallel laser beams were emitted into an ink chamber 12 through an objective lens of a metallurgical microscope. With the laser beam focused onto the bottom of the ink chamber 12, the laser beams reflected therefrom and passing again through the objective lens were compared with the incident laser beams for phase difference. As changes in the TPM pressure level inside the ink chamber 12 varied the refractive index, the time required for the laser beams to pass through the ink chamber varied. Thus, detecting the phase difference of the laser beams allowed the internal pressure of the ink chamber 12 to be measured. As shown in FIG. 2, the measurements indicate that the pressure inside the ink chamber 12 was substantially the highest when the ratio of side wall height to side wall width (H/B) was at least 2.5 and at most 8.

Meanwhile, the inventor modeled the ink jet apparatus formed by the piezoelectric ceramic plate 1, the side walls 11 of which the height-to-width ratio (H/B) ranged from 1 to 10, the junction layer 3, and the cover plate 2. The models were subjected to numerical analysis based on the finite element method. The relations were analyzed between the ratio of side wall height to side wall width (H/B) and the pressure P inside ink chambers 12. The pressure P was estimated by use of the expression $$P=K\cdot\Delta/C$$

where, Δ denotes the amount of static deformation of the side walls 11 caused when the driving voltage was applied to the corresponding metal electrodes 13 with no ink inside the ink chamber 12 (i.e., reduction of volume of ink chamber 12), C represents the amount of static deformation of the side walls 11 caused when the pressure P was applied to the wall surfaces (i.e., compliance of the side walls), and K is a constant determined by such factors as the piezoelectric and mechanical characteristics of the piezoelectric ceramic plate 1 as well as the compression characteristic of the ink used. The results of the analysis, given in FIG. 2, show that the pressure P inside the ink chamber 12 reached 85% or higher of its maximum value when the height-to-width ratio of the side walls 11 (H/B) ranged from 2.5 to 8, and that the pressure P reached about 70% of its maximum value when the H/B ratio ranged from 2 to 9. The results match the measurements mentioned above.

Given the results above, the embodiment of FIG. 1 is constructed so that the height-to-width ratio of the side walls 11 (H/B) will range from 2 to 9 and preferably from 2.5 to 8. If the H/B ratio fell out of the above ranges, that would reduce the ratio of the ink pressure inside the ink chamber 12 to the driving voltage fed to the metal electrodes 13. This would make it impossible, given relatively low driving voltages, to render the velocity and volume of jetted ink droplets high enough and large enough to form characters and images onto the paper or like medium opposite to the ink jet printer head. To obtain higher driving voltage, the driving circuit must be larger and more complicated. By contrast, this embodiment generates ink pressure more efficiently in the ink chamber using relatively low driving voltages. The resulting pressure is high enough to keep the velocity of jetted ink droplets sufficiently high and the volume thereof sufficiently large to form characters and images onto the printing medium. According to the invention, driving voltages of as low as 20 to 50 volts still provide ink droplet velocities of 3 to 8 m/s and ink volumes of 30 to 90 pl. With the driving circuit thus made smaller and simpler in structure, the entire ink jet apparatus incorporating it is also reduced in size and manufactured at a lower cost.

II. The relationship between the ratio of side wall width to side wall pitch (B/Z) on the one hand, and the pressure P inside ink chambers on the other Referring to FIG. 3, in developing the invention, the inventor modeled the ink jet apparatus characterized by various ratios of side wall width to side wall pitch (B/Z). With the apparatus set to the varying B/Z ratios, the same driving voltage was applied to the metal electrodes 13, and the pressure levels generated accordingly in the ink chambers 12 were measured. The sizes and materials of the embodied apparatus as well as the manner in which the apparatus was produced and pressure measurements taken were the same as those described in the section I of this specification.

Figure 3:
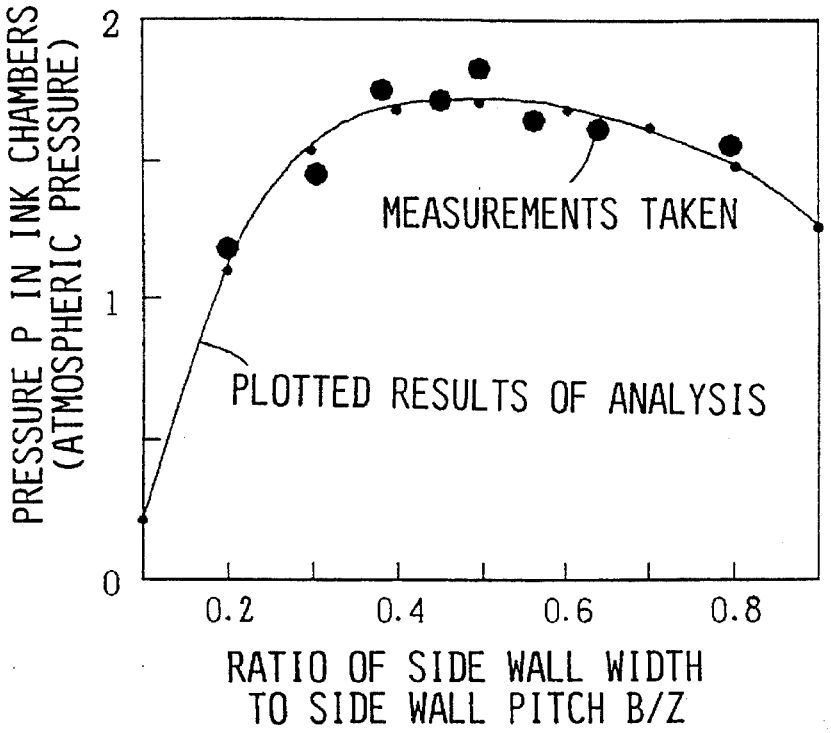
FIG. 3 is a graph depicting typical relations between the ratio of side wall width to side wall pitch (B/Z) on the one hand, and the pressure P inside ink chambers on the other in the invention.

As depicted in FIG. 3, the measurements show that the pressure inside the ink chamber 12 was maximized when the ratio of side wall width to side wall pitch (B/Z) ranged from 0.3 to 0.8.

Meanwhile, the inventor modeled the ink jet apparatus made of the piezoelectric ceramic plate 1, the side walls 11 of which the ratio of side wall width to side wall pitch (B/Z) ranged from 0.1 to 0.9, the junction layer 3, and the cover plate 2. The models were subjected to numerical analysis based on the finite element method. The relations were analyzed between the ratio of side wall width to side wall pitch (B/Z) on the one hand, and the pressure P inside ink chambers 12 on the other. The pressure P was estimated by use of the same expression and in the same manner as those described in the section I of this specification. The results of the analysis, given in FIG. 3, show that the pressure P inside the ink chamber 12 reached 85% or higher of its maximum value when the ratio of side wall width to side wall pitch (B/Z) ranged from 0.3 to 0.8, and that the pressure P reached about 70% of its maximum value when the B/Z ratio ranged from 0.2 to 0.9. The results match the measurements mentioned above.

Given the results above, the embodiment of FIG. 1 is alternatively formed so that the ratio of side wall width to side wall pitch (B/Z) will range from 0.2 to 0.9 and preferably from 0.3 to 0.8. If the B/Z falls out of the above ranges, that would reduce the ratio of the ink pressure inside the ink chamber 12 to the driving voltage fed to the metal electrodes 13. This would make it impossible, given relatively low driving voltages, to render the velocity and volume of jetted ink droplets high enough and large enough to form characters and images onto the paper or other medium opposite to the ink jet printer head. To obtain higher driving voltage, the driving circuit must be larger and more complicated. By contrast, this embodiment generates ink pressure more efficiently in the ink chamber using relatively low driving voltages. The resulting elevated pressure keeps the velocity of jetted ink droplets sufficiently high and the volume thereof sufficiently large to form characters and images onto the printing medium. According to the invention, driving voltages of as low as 20 to 50 volts still provide ink droplet velocities of 3 to 8 m/s and ink volumes of 30 to 90 pl. With the driving circuit thus made smaller and simpler in structure, the entire ink jet apparatus incorporating it is also reduced in size and manufactured at a lower cost.

III. The relationship between the curvature R of the side wall bottom and the principal stress σ thereof The inventor also produced an ink jet apparatus having various curvatures R of the side wall bottom. Driving voltages were applied to the metal electrodes 13 to jet out ink droplets about one billion times. The sizes and the materials of the produced ink jet apparatus were the same as those of the embodiment described in the section I of this specification. The grooves 15 were machined by use of disc-shaped diamond blade tools, the blade being slightly narrower than the width of each groove 15. The outer edges of the diamond blades were cut in advance to various curvatures. These diamond blades were used to produce side walls 11 of which the bottom curvature R ranged from 3 μm to 40 μm.

When the ink jet apparatus described above was tested to jet out ink droplets about one billion times, it was found that the side wall bottoms partially developed cracks resulting in a partial side wall destruction. The damaged side walls were not deformed normally when the corresponding metal electrodes 13 received the driving voltage. Consequently, no ink droplets were jetted from the corresponding ink chambers. Examinations revealed that most of the damaged side walls had small bottom curvatures R. That is, up to 8% of the tested side walls were damaged when their bottom curvature R was 3 μm; 1% were damaged when the curvature was 4 μm; 0.2% were damaged when the curvature was 5 μm; and 0.002% were damaged when the curvature was 6 μm. No side walls were destroyed when their bottom curvature R was 7 μm or more.

Figure 4:
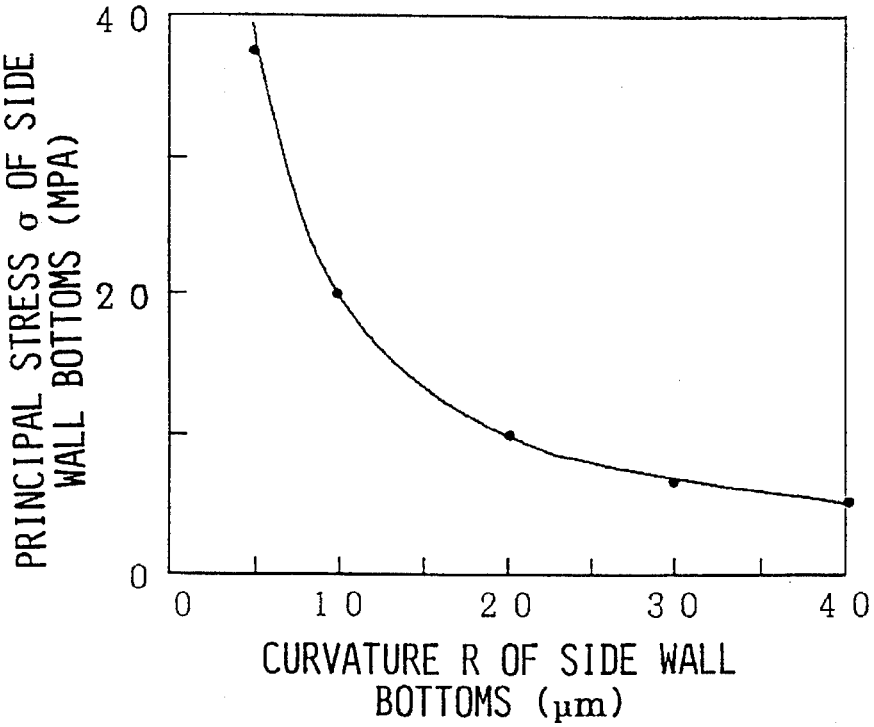
FIG. 4 is a graph illustrating typical relations between the curvature R of the side wall bottom and the principal stress σ thereof in the invention.

Meanwhile, the inventor modeled an ink jet apparatus made of the piezoelectric ceramic plate 1, the side walls 11 of which the bottom curvature R ranged from 3 μm to 40 μm, the junction layer 3, and the cover plate 2. The models were subjected to numerical analysis based on the finite element method. The relations were analyzed between the curvature R of the side wall bottoms and the principal stress σ thereof. The results of the analysis, given in FIG. 4, show that as the side wall bottom curvature R becomes smaller, the principal stress σ rapidly increases. Overall, the results of the above testing and analysis indicate that the smaller the curvature R of the side wall bottom, the greater the increase in the principal stress σ thereof. Further, once the principal stress σ exceeds the rupture strength of the piezoelectric ceramic plate 1, the bottoms of part of the side walls develop cracks leading to a partial side wall destruction.

Given the results above, the embodiment of FIG. 1 is alternatively built so that the side wall curvature R will be at least 5 μm and preferably 7 μm or more. This ink jet apparatus does not develop cracks at the side wall bottoms and will not be destroyed after jetting out ink droplets about one billion times. This is a reliable ink jet apparatus that keeps jetting out ink droplets after a very large number of times of ink jet operation.

Figure 5:
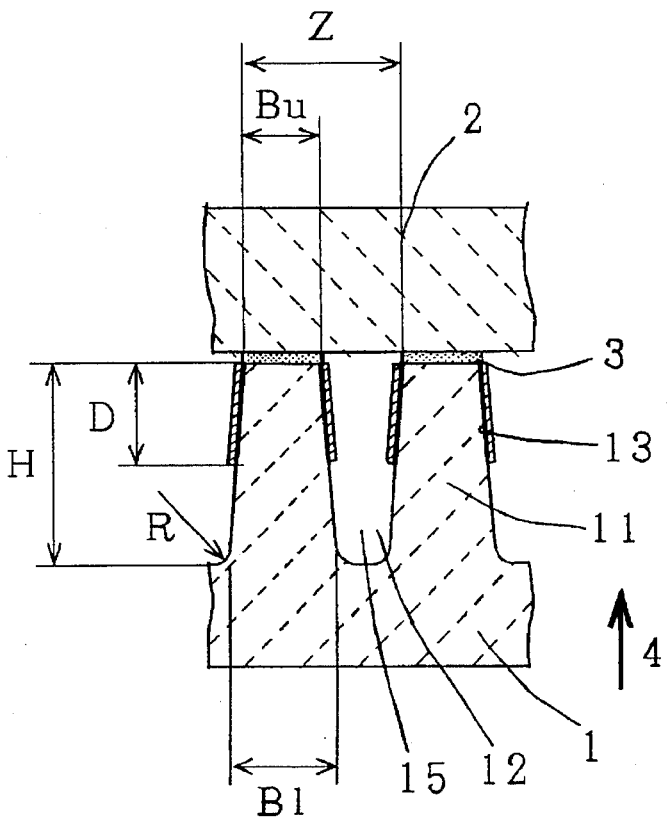
FIG. 5 is an enlarged partial cross-sectional view of an ink jet apparatus in another embodiment of the invention.

IV. The relationship between the taper T of side walls and the pressure P inside ink chambers Another embodiment of the invention is outlined referring to FIG. 5. FIG. 5 is a partial cross-sectional view of this embodiment. A piezoelectric ceramic plate 1 comprises a plurality of grooves 15 and side walls 11 that separate the grooves 15 and is polarized in the direction of arrow 4. A cover plate 2 is made of ceramic or plastic resin. The piezoelectric ceramic plate 1 and the cover plate 2 are bonded together with a junction layer 3 interposed therebetween. The junction layer 3 is composed of epoxy resin adhesive or the like. In this structure, the grooves 15 form a plurality of ink chambers 12 spaced apart crosswise. Each side wall 11 has a trapezoidal cross section (narrower toward the top contacting the cover plate 2 and wide toward the bottom), is long and narrow in shape, and extends along the entire length of the ink chamber 12. Both sides of each wall 11 from the wall top near the junction layer 3 to the approximate middle of the wall are furnished with metal electrodes 13 that apply driving electric fields. All ink chambers 12 are filled with ink. The parameters representing the shapes of side walls 11 and metal electrodes 13 are described below. H stands for the height of the side walls 11, Bu for the width of the side wall top, Bl for the width of the side wall bottom, Z for the pitch of the side walls 11, R for the curvature of the side wall bottoms, and D for the distance from top to bottom of the metal electrodes 13 formed on the surfaces of the side walls 11. The taper T of the side walls is given by the expression $$T=(Bl-Bu)/H$$

Figure 6:
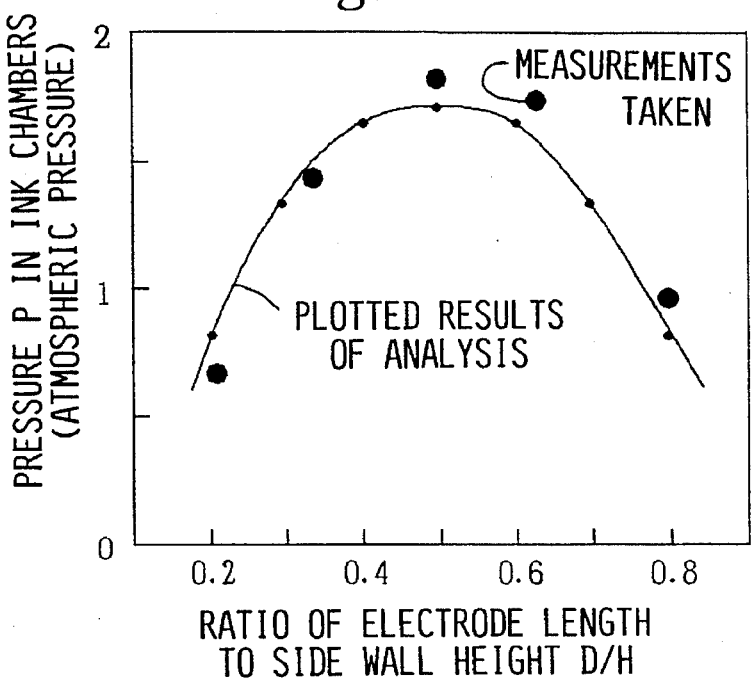
FIG. 6 is a graph indicating typical relations between the ratio of electrode length to side wall height (D/H) on the one hand, and the pressure P inside ink chambers on the other in the invention.
Figure 7:
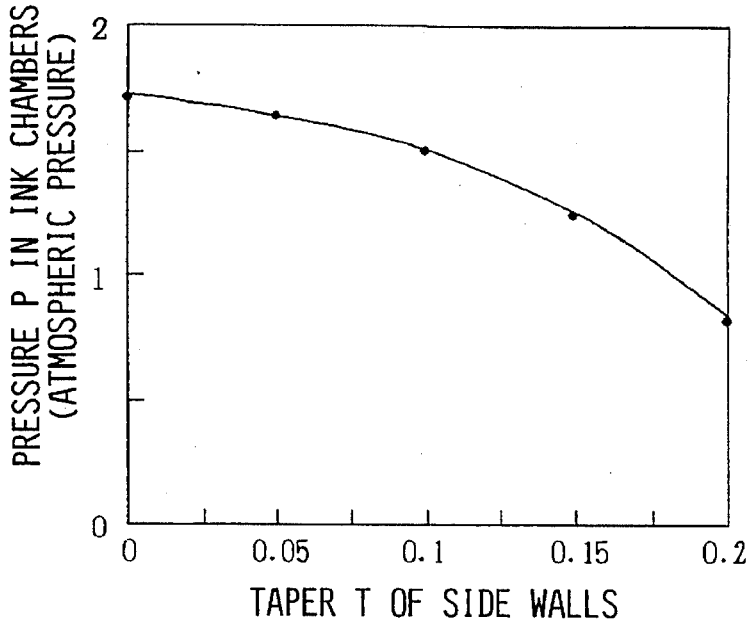
FIG. 7 is a graph exhibiting typical relations between the taper T of side walls and the pressure P inside ink chambers in the invention.

The structure of the embodiment of FIG. 5 is described referring to FIGS. 6 and 7. FIG. 6 indicates typical relations between the ratio of electrode length to side wall height (D/H) on the one hand, and the pressure P inside the ink chambers 12 on the other. FIG. 7 exhibits typical relations between the taper T of the side walls and the pressure P inside the ink chambers. The inventor produced an ink jet apparatus wherein the side wall taper T ranged from 0 to 0.2 and the ratio of electrode length to side wall height (D/H) varied from 0.2 to 0.8. With this apparatus, the same driving voltage was applied to the metal electrodes 13, and the pressure levels generated accordingly in the ink chambers 12 were measured. Except for the electrode length, the sizes and the materials of the produced ink jet apparatus were the same as those of the embodiment described in the section I of this specification.

FIG. 6 highlights the relations between the ratio of electrode length to side wall height (D/H) and the pressure P inside the ink chambers of the ink jet apparatus with its side wall taper T set to 0.05. The measurements taken indicate that the pressure inside the ink chamber 12 was maximized when the ratio of electrode length to side wall height (D/H) was around 0.5.

Meanwhile, the inventor modeled the ink jet apparatus with the piezoelectric ceramic plate 1, the side walls 11 of which the ratio of electrode length to side wall height (D/H) ranged from 0.2 to 0.8, the junction layer 3, and the cover plate 2. The models were subjected to numerical analysis based on the finite element method. The relations were analyzed between the side wall taper T, the ratio of electrode length to side wall height (D/H), and the pressure P inside the ink chambers 12. The pressure P was estimated in the same manner as that described in the section I of this specification.

As mentioned, FIG. 6 depicts the relations between the ratio of electrode length to side wall height (D/H) and the pressure P inside the ink chambers of the ink jet apparatus with its side wall taper T set to 0.05. The results of the analysis show that the pressure inside the ink chamber 12 was maximized when the ratio of electrode length to side wall height (D/H) was about 0.5. These results match the measurements taken above.

Given the results above, it is clear that the ink jet apparatus with its side wall taper T set to 0.05 provides the maximum internal pressure of the ink chamber 12 when the ratio of electrode length to side wall height (D/H) is about 0.5.

Modified ink jet apparatuses with their side wall taper T ranging from 0 to 0.02 were then subjected to similar measurement and analysis procedures. With the side walls taking diverse shapes and with the ratio of electrode length to side wall height (D/H) varied, the pressure P in the ink chamber 12 was examined. The results, plotted in FIG. 7, indicate that the pressure P in the ink chamber was maximized when the side wall taper T was 0, and that the pressure P was reduced by about 15% when the side wall taper T was 0.1. When the side wall taper T was 0.16 or more, the pressure P inside the ink chamber was reduced by more than 30%. Thus it was impossible, given relatively low levels of electric energy applied to the metal electrodes 13, to render the velocity and volume of jetted ink droplets high enough and large enough to form characters and images onto the paper or like medium opposite to the ink jet printer head. It should take this type of ink jet apparatus an appreciably high driving voltage to jet out ink droplets at sufficient velocities and in sufficient volumes to form characters and images. That in turn requires building a large and complicated driving circuit that would put severe constraints on the effort to make the ink jet apparatus smaller in size and lower in manufacturing cost.

Using the same measurement and analysis procedures, the inventor also tested modifications of the apparatus wherein the side wall taper T was negative. The tests revealed approximately the same results in terms of the absolute value of the side wall taper T.

Given the results above, the embodiment of FIG. 5 is formed so that the side wall taper T will be 0.16 or less and preferably 0.1 at most. This embodiment generates ink pressure more efficiently in the ink chamber 12 using relatively low driving voltages. The resulting elevated pressure keeps the velocity of jetted ink droplets sufficiently high and the volume thereof sufficiently large to form characters and images onto the printing medium. According to the invention, driving voltages of as low as 20 to 50 volts still provide ink droplet velocities of 3 to 8 m/s and ink volumes of 30 to 90 pl. With the driving circuit thus made smaller and simpler in structure, the entire ink jet apparatus incorporating it is also reduced in size and manufactured at a lower cost.

Figure 8:
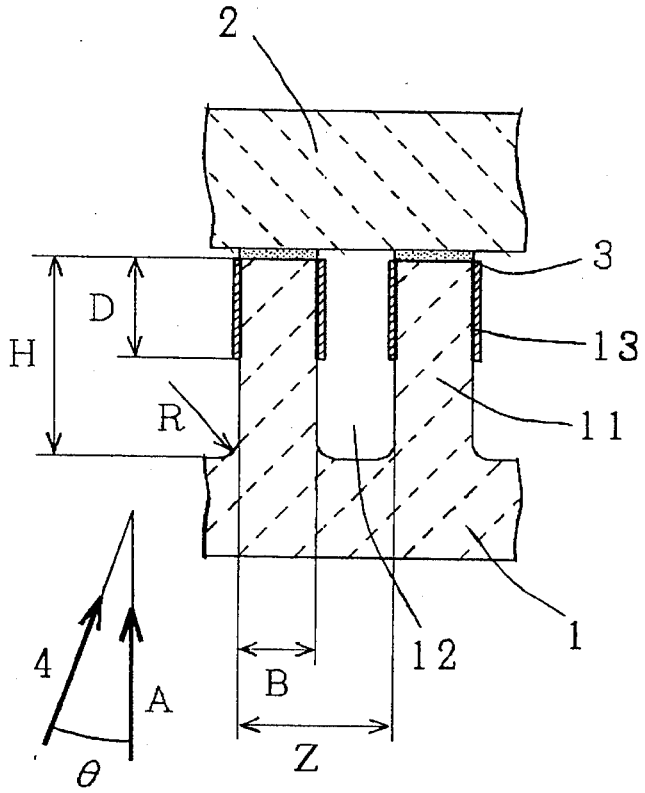
FIG. 8 is an enlarged partial cross-sectional view of an ink jet apparatus in another embodiment of the invention.

V. The relationship of the angle θ between the longitudinal direction of side walls and the direction of polarization thereof and its relation to the pressure P inside the ink chambers The parameters representing the shapes of side walls 11 and metal electrodes 13 are described referring to FIG. 8. FIG. 8 is a partial cross-sectional view of another embodiment of the invention. H stands for the height of the side walls 11 provided on the piezoelectric ceramic plate 1, B for the width of the side walls 11, Z for the pitch of the side walls 11, R for the curvature of the side wall bottoms, D for the distance from top to bottom of the metal electrodes 13 formed on the surfaces of the side walls 11, and θ for the angle formed between the longitudinal direction of side walls and the direction of polarization thereof.

Figure 9:
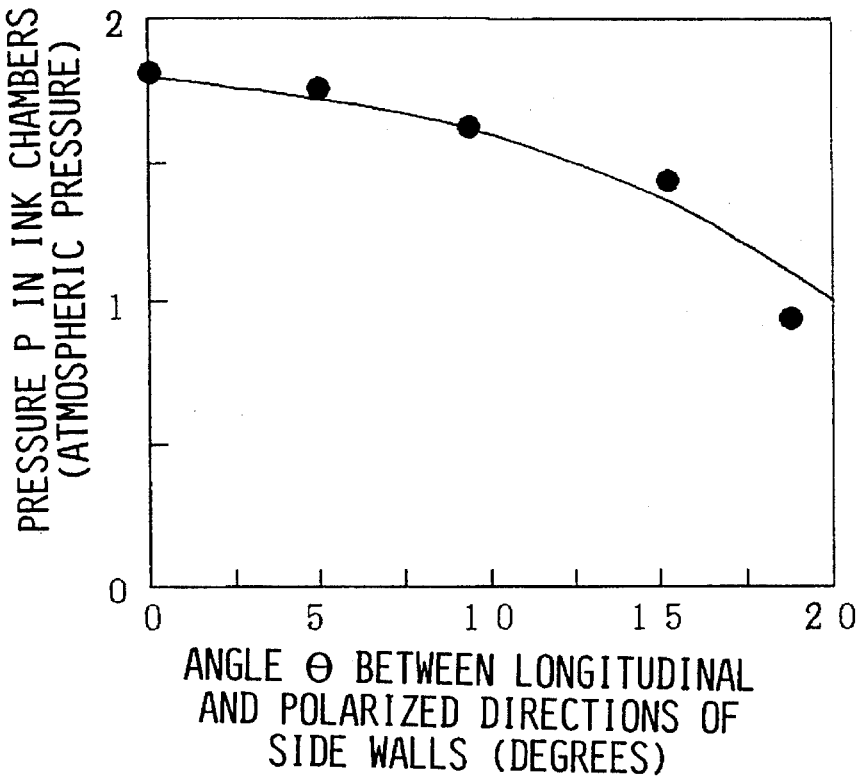
FIG. 9 is a graph showing how the angle θ between the longitudinal direction of side walls and the direction of polarization thereof relates illustratively to the pressure P inside ink chambers in the invention.

The construction of the embodiment of FIG. 8 is described referring to FIG. 9, which shows how the angle θ between the longitudinal direction (arrow A) of side walls and the direction of polarization thereof relates illustratively to the pressure P inside the ink chamber 12. The inventor produced the ink jet apparatus wherein the angle θ was varied in a diverse manner. With this apparatus, the same driving voltage was applied to the metal electrodes 13, and the pressure levels generated accordingly in the ink chambers 12 were measured. The sizes and the materials of the produced ink jet apparatus as well as the way in which to produce the apparatus and to take pressure measurements thereof were the same as those described in the section I of this specification. It should be noted that the piezoelectric ceramic plate 1 was a wafer cut by a slicer from a block. The block was composed of previously polarized barium titanate piezoelectric ceramics. The cut from the block was accomplished in a plane direction of 90-θ relative to the direction of polarization of the block. The metal electrodes 13 were made of an aluminum layer about 1 μm thick and formed by vacuum evaporation. The cover plate 2 was made of borosilicate glass, and the junction layer 3 was made of epoxy resin adhesive. The angle θ ranged from 0 to 20 degrees.

As depicted in FIG. 9, the pressure P in the ink chamber 12 was maximized when the angle θ between the arrowed direction A and the direction of polarization was 0; the pressure P was reduced by about 15% when the angle θ was 14 degrees; and the pressure P was reduced by 30% or more when the angle θ was 18 degrees or more. Thus it was impossible, given relatively low levels of electric energy applied to the metal electrodes 13, to render the velocity and volume of jetted ink droplets high enough and large enough to form characters and images onto the paper or other medium opposite to the ink jet printer head. It should take this type of ink jet apparatus an appreciably high driving voltage to jet out ink droplets at sufficient velocities and in sufficient volumes to form characters and images. That in turn requires building a large and complicated driving circuit that would place severe constraints on the effort to make the ink jet apparatus smaller in size and lower in manufacturing cost.

Given the results above, the embodiment of FIG. 8 is constructed so that the angle θ between the longitudinal direction of the side walls and the direction of polarization thereof will be 18 degrees or less and preferably 14 degrees at most. This embodiment generates ink pressure more efficiently in the ink chamber 12 using relatively low driving voltages. The resulting elevated pressure keeps the velocity of jetted ink droplets sufficiently high and the volume thereof sufficiently large to form characters and images onto the printing medium. According to the invention, driving voltages of as low as 20 to 50 volts still provide ink droplet velocities of 3 to 8 m/s and ink volumes of 30 to 90 pl. With the driving circuit thus made smaller and simpler in structure, the entire ink jet apparatus incorporating it is also reduced in size and manufactured at a lower cost.

VI. The relationship between the curvature r of groove bottoms and the jet velocity v of ink droplets The construction of another embodiment and the parameters representing the shape of the grooves 15 therein is described with reference to FIG. 10, which is a cross-sectional side view of this embodiment. The grooves 15 forming part of the ink chambers 12 are parallel grooves of the same depth stretching from the edge 16 to an inner point 51 inside the piezoelectric ceramic plate 1. From the point 51 toward the edge 17, each groove 15 becomes shallower with a curvature r. Near the edge 17, the grooves 15 are replaced by parallel grooves 18 of a shallower depth. In the longitudinal direction of each ink chamber 12, the point 51 coincides with an edge 23 of a manifold 22. This arrangement is intended to make the driving portion of the side walls 11 as elongated as possible, the manifold 22 as large as possible in volume, and the cover plate 2 as small as possible in size. The inner surfaces of the parallel grooves 15 and 18 are furnished with the metal electrodes 13. The electrodes are deposited on the wall surfaces by sputtering or by other suitable processes. While only the upper half of the side walls of the grooves 15 is equipped with the metal electrodes 13, the entire side walls and the bottoms of the shallow parallel grooves 18 are covered with the metal electrodes.

Figure 11:
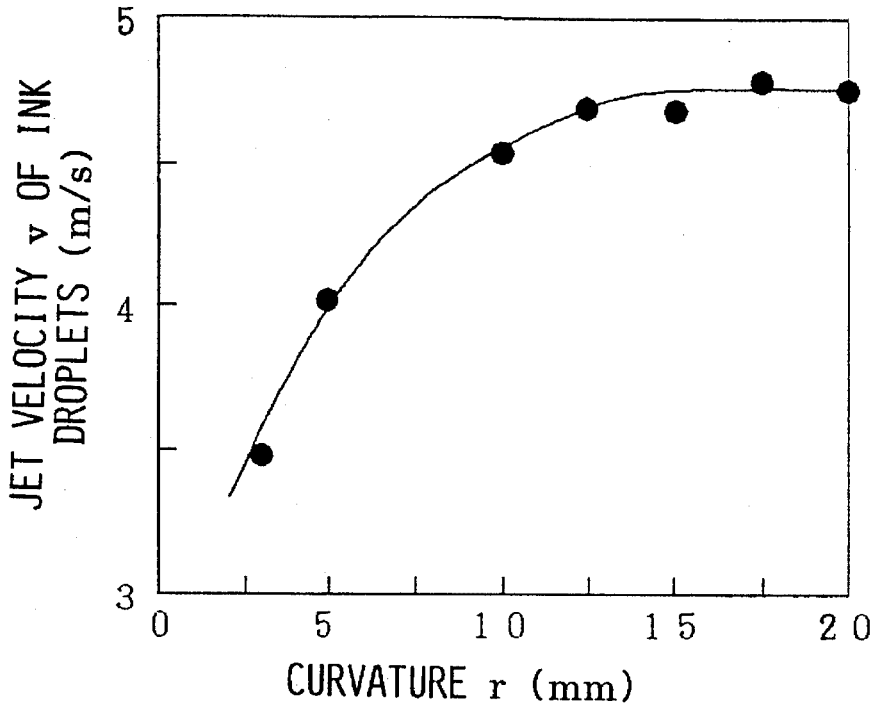
FIG. 11 is a graph sketching typical relations between the curvature r of groove bottoms and the jet velocity v of ink droplets in the invention.

More details of the construction of this embodiment are described referring to FIG. 11, which sketches typical relations between the curvature r of groove bottoms and the jet velocity v of ink droplets. The inventor produced an ink jet apparatus wherein the groove bottom curvature r was varied in a diverse manner. With this apparatus, the same driving voltage was applied to the metal electrodes 13, and the velocities v of ink droplets jetted accordingly from the nozzle 32 were measured. The sizes and the materials of the produced ink jet apparatus as well as the way in which to produce the apparatus and to take pressure measurements thereof were the same as those described in the section I of this specification.

As shown in FIG. 11, the jet velocity v of ink droplets was maximized and was substantially constant when the curvature r was 15 mm or more; the jet velocity v was reduced by about 10% when the curvature r was 7 mm; and the jet velocity v was lowered by as much as 15% or more when the curvature r was 5 mm or less. Thus it was impossible, given relatively low levels of electric energy applied to the metal electrodes 13, to render the velocity of jetted ink droplets high enough to form characters and images onto the paper or like medium opposite to the ink jet printer head. It should take this type of ink jet apparatus a significantly high driving voltage to jet out ink droplets at sufficient velocities to form characters and images. That in turn requires building a large and complicated driving circuit that would place severe constraints on the effort to make the ink jet apparatus smaller in size and lower in manufacturing cost.

The above deterioration in the jet velocity of ink droplets is thought to occur as follows. As the curvature r becomes smaller, the resistance to the ink flow from the ink supply port 12 through the manifold 22 and the groove bottom (with the curvature r) to the ink chamber 12 increases. When the amount of ink supply into the ink chamber 12 fails to keep up with the amount of the ink droplets being jetted out, a negative pressure develops inside the ink chamber 12. This lowers the pressure that should be generated in the ink chamber when the driving voltage is applied to the corresponding metal electrodes 13. The lower the pressure generated inside the ink chamber 12, the lower the jet velocity of ink droplets.

Figure 10:
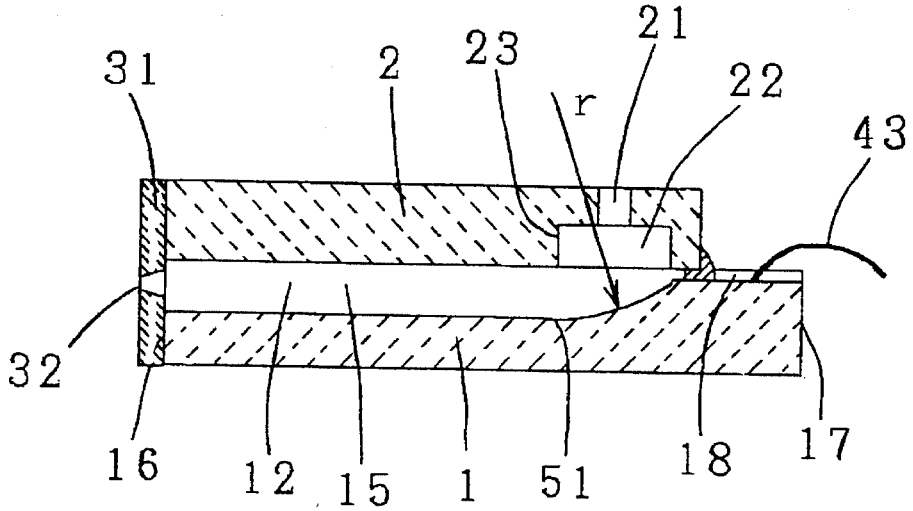
FIG. 10 is an enlarged cross-sectional side view of an ink jet apparatus in another embodiment of the invention.

Given the results above, the embodiment of FIG. 10 is constructed so that the bottom curvature of the curved grooves contiguous to the constant-depth grooves constituting the ink chambers will be at least 5 mm and preferably 7 mm or more. This embodiment efficiently enhances the jet velocity of ink droplets. That is, using relatively low driving voltages, the embodiment keeps the velocity of jetted ink droplets sufficiently high and the volume thereof sufficiently large to form characters and images onto the printing medium. According to the invention, driving voltages of as low as 20 to 50 volts still provide ink droplet velocities of 3 to 8 m/s and ink volumes of 30 to 90 pl. With the driving circuit thus made smaller and simpler in structure, the entire ink jet apparatus incorporating it is also reduced in size and manufactured at a lower cost.

VII. The relationship between the taper t of groove bottoms and the jet velocity v of ink droplets The construction of another embodiment and the parameters representing the shape of the grooves 15 therein are described referring to FIG. 12, which is a cross-sectional view of this embodiment. The grooves 15 forming part of the ink chambers 12 are parallel grooves stretching from the edge 16 to the inner point 51 inside the piezoelectric ceramic plate 1. Over that stretch, the grooves 15 are either the same depth or have depths varying in a linearly gradual manner in the longitudinal direction of the grooves. The grooves 15 have a depth of Hn at the part contacting the nozzle plate 31 and have a depth of Hm at the part contacting the manifold 22. The bottom taper t of the grooves 15 is given by the expression $$t=(Hn-Hm)/L$$

where, L denotes the length between the point 51 and the position at which the grooves 15 contact the nozzle plate 31. From the point 51 toward the edge 17, each groove 15 becomes shallower with a curvature r. Near the edge 17, the grooves 15 are replaced by parallel grooves 18 of a shallower depth. The inner surfaces of the parallel grooves 15 and 18 are furnished with the metal electrodes 13. The electrodes are deposited on the wall surfaces by sputtering or by other suitable processes. While only the upper half of the side walls of the grooves 15 is equipped with the metal electrodes 13, the entire side walls and the bottoms of the shallow parallel grooves 18 are covered with the metal electrodes.

Figure 13:
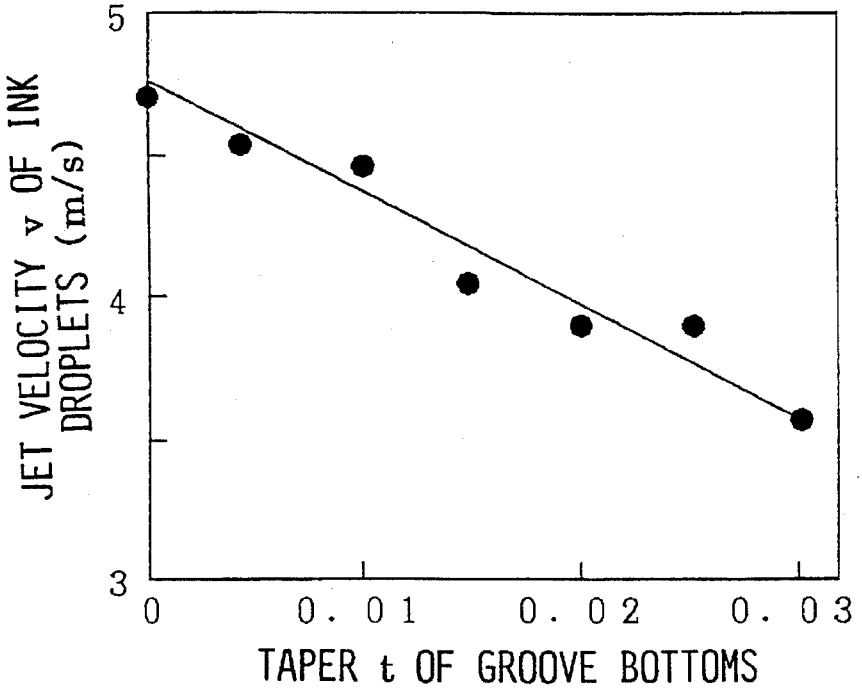
FIG. 13 is a graph showing typical relations between the taper t of groove bottoms and the jet velocity v of ink droplets in the invention.

More details of the construction of this embodiment are described referring to FIG. 13, which shows typical relations between the taper t of groove bottoms and the jet velocity v of ink droplets. The inventor produced the ink jet apparatus wherein the groove bottom taper t was varied in a diverse manner. With this apparatus, the same driving voltage was applied to the metal electrodes 13, and the velocities v of ink droplets jetted accordingly from the nozzle 32 were measured. The width B of the side walls 1 in the produced ink jet apparatus ranged from 40 μm to 120 μm. The side wall height H ranged from 200 μm to 1000 μm toward the higher end of their linear elevation, and varied from 100 μm to 400 μm toward the lower end. The length D of the metal electrodes 13 was approximately half the height H of the side walls 11 where the metal electrodes 13 were formed. Over the stretch where the side wall height H varied in a linearly gradual manner, the length D of the metal electrodes 13 also varied linearly. The piezoelectric ceramic plate 1 was formed of barium titanate piezoelectric ceramics. The metal electrodes 13 were made of an aluminum layer about 1 μm thick and formed by vacuum evaporation. The cover plate 2 was made of borosilicate glass, and the junction layer 3 was made of epoxy resin adhesive. The ink used was tripropylene glycol monomethyl ether (TPM)-based pigment ink. The driving voltage applied to the metal electrodes 13 was 40 volts.

As shown in FIG. 13, the jet velocity v of ink droplets was maximized when the bottom taper t of the grooves 15 was 0; the jet velocity v was reduced by about 10% when the groove bottom taper t was 0.012; and the jet velocity v was lowered by as much as 15% or more when the groove bottom taper t was 0.02 or more. Thus it was impossible, given relatively low levels of electric energy applied to the metal electrodes 13, to render the velocity of jetted ink droplets high enough to form characters and images onto the paper or like medium opposite to the ink jet printer head. It should take this type of ink jet apparatus a significantly high driving voltage to jet out ink droplets at sufficient velocities to form characters and images. That in turn requires building a large and complicated driving circuit that would place severe constraints on the effort to make the ink jet apparatus smaller in size and lower in manufacturing cost.

The above deterioration in the jet velocity of ink droplets is thought to occur as follows. As the bottom taper t of the grooves 15 becomes larger, application of the driving voltage to the metal electrodes 13 produces a difference in pressure between the portion where the grooves 15 contact the nozzle plate 31 and the portion where the grooves 15 are close to the manifold 22. When the pressure waves generated at various positions inside the grooves 15 reach the nozzle successively, the ink pressure at the nozzle fluctuates. This means that the rate of ink flow through the nozzle is subject to the ink pressure fluctuation immediately after application of the driving voltage. Compared with the case where the ink flow remains constant, the fluctuating ink flow tends to incur considerable energy losses due to such resistance to ink flow as inertial resistance. The losses of energy lower the jet velocity v of ink droplets.

Using the same measurement and analysis procedures, the inventor also verified that when the groove bottom tapers t were negative (i.e., inverse tapers), the results were the same in terms of the absolute taper values.

Figure 12:
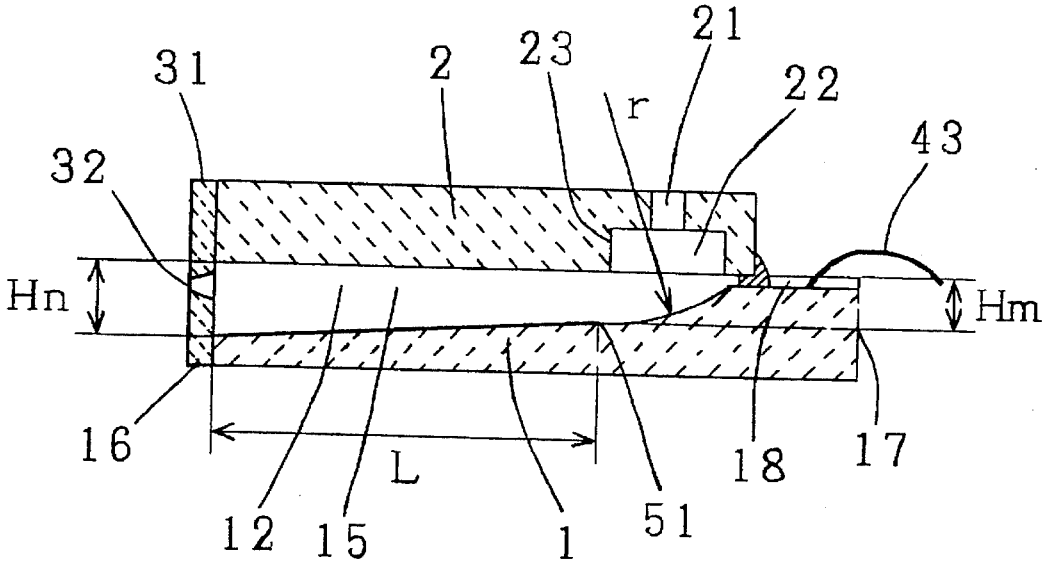
FIG. 12 is an enlarged cross-sectional side view of an ink jet apparatus in another embodiment of the invention.

Given the results above, the embodiment of FIG. 12 is constructed so that the absolute values of the taper will be 0.02 or less and preferably 0,012 at most, the taper being formed between the plane direction of the piezoelectric ceramic plate and those grooves forming part of the ink chambers and having linearly varying depth. This embodiment efficiently enhances the jet velocity of ink droplets. That is, using relatively low driving voltages, the embodiment keeps the velocity of jetted ink droplets sufficiently high and the volume thereof sufficiently large to form characters and images onto the printing medium. According to the invention, driving voltages of as low as 20 to 50 volts still provide ink droplet velocities of 3 to 8 m/s and ink volumes of 30 to 90 pl. With the driving circuit thus made smaller and simpler in structured the entire ink jet apparatus incorporating it is also reduced in size and manufactured at a lower cost.

Figure 14:
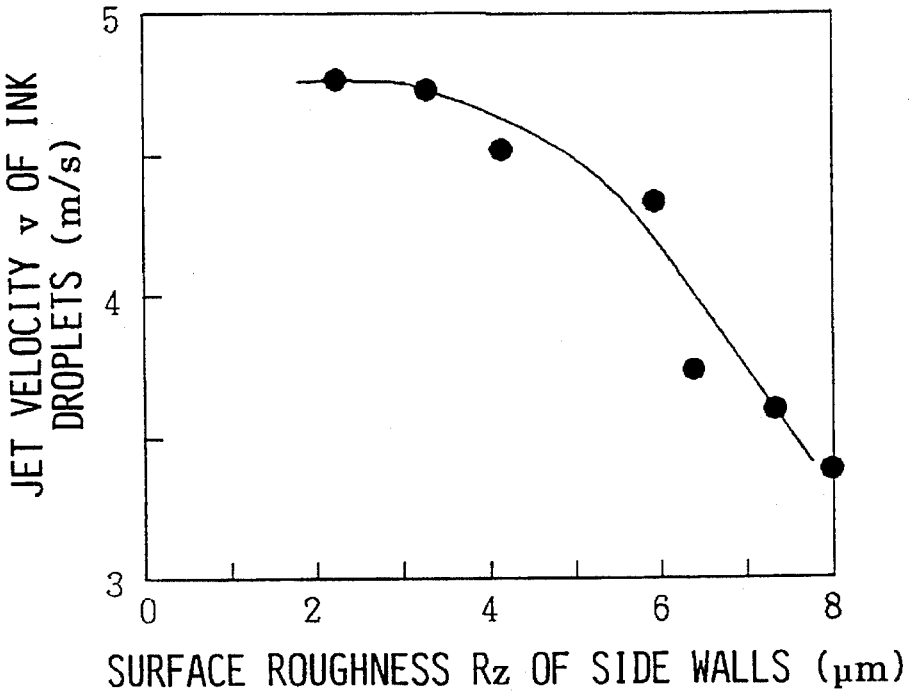
FIG. 14 is a graph picturing typical relations between the surface roughness Rz of side walls and the jet velocity v of ink droplets in the invention.
Figure 15:
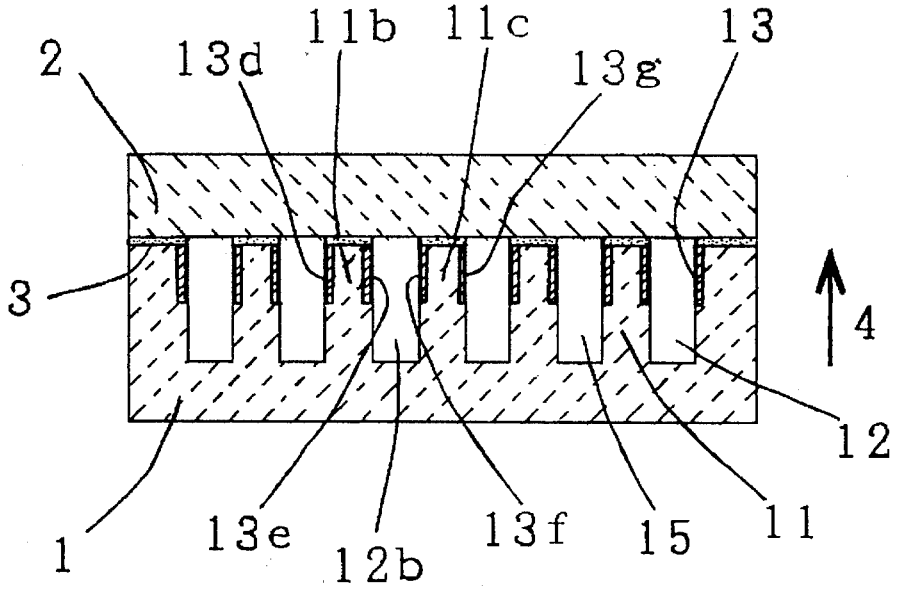
Fig.15 PRIOR ART
FIG. 15 is a cross-sectional view of the typical prior art ink jet apparatus.
Figure 16:
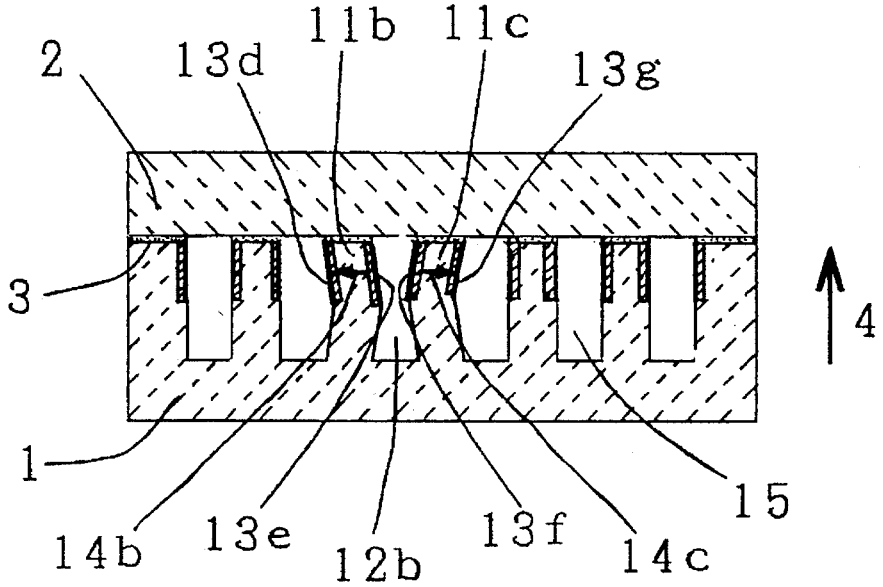
Fig.16 PRIOR ART
FIG. 16 is another cross-sectional view of the typical prior art ink jet apparatus.
Figure 17:
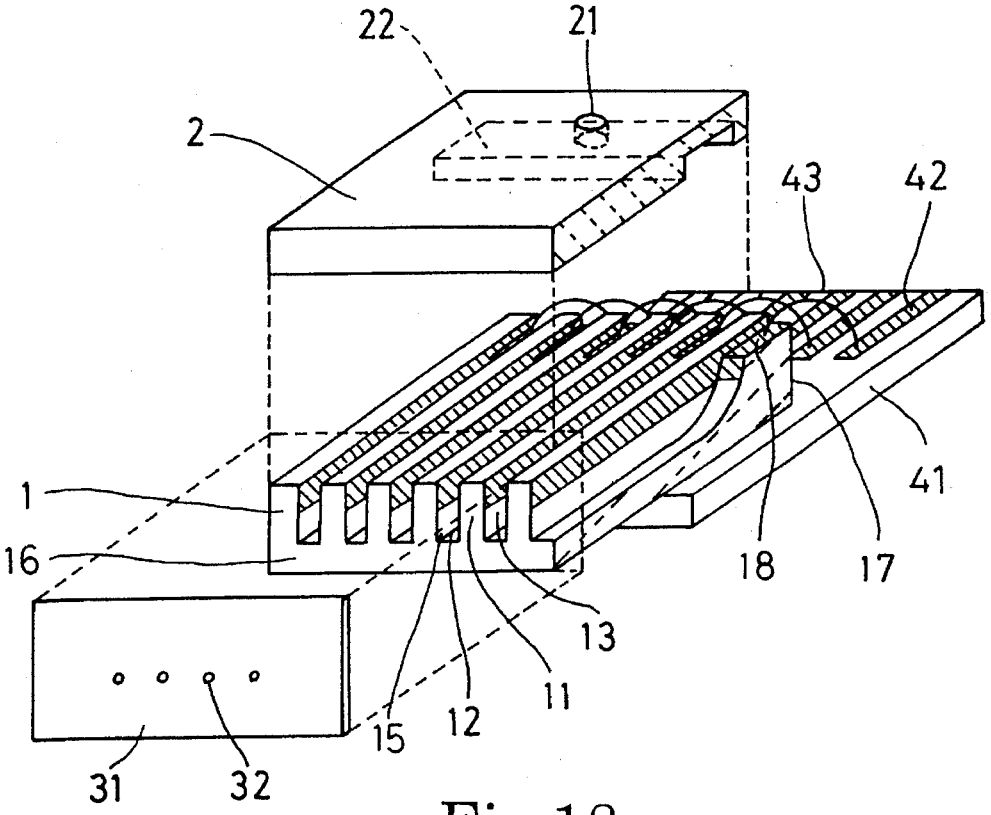
Fig.17 PRIOR ART
FIG. 17 is an exploded perspective view in partial section of the typical prior art ink jet apparatus.
Figure 18:
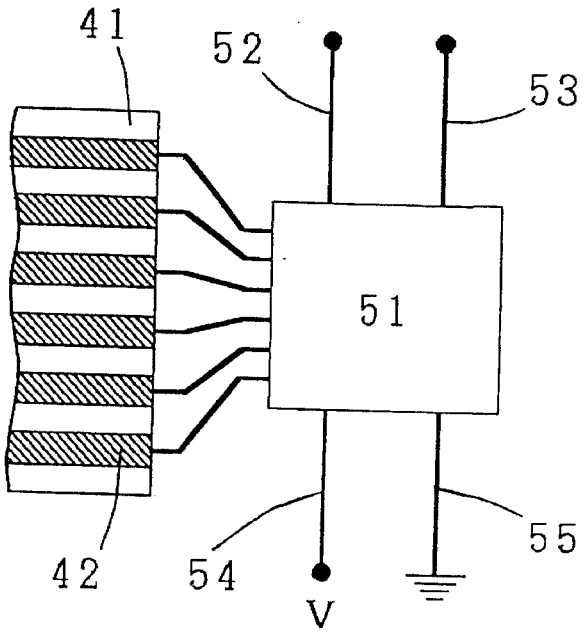
Fig.18 PRIOR ART
FIG. 18 is a schematic diagram of the control section of the typical prior art ink jet apparatus.

VIII. The relationship between the surface roughness Rz of side walls and the jet velocity v of ink droplets Described below with reference to FIG. 14 is the relationship between the surface roughness Rz of side walls and the jet velocity v of ink droplets in connection with the embodiment of FIG. 12. The inventor produced an ink jet apparatus wherein the surface roughness Rz of the side walls was varied in a diverse manner. With this apparatus, the same driving voltage was applied to the metal electrodes 13, and the pressure levels generated accordingly in the ink chambers 12 were measured. Thin, disc-shaped diamond blade tools with their diamond grain sizes suitably varied were used to produce the grooves 15 of which the surface roughness Rz ranged from 2 μm to 8 μm. The sizes and the materials of the produced ink jet apparatus as well as the manner in which to produce the apparatus and to take pressure measurements thereof were the same as those described in the section I of this specification.

As depicted in FIG. 14, the measurements taken indicate that the jet velocity v of ink droplets was maximized and was substantially constant when the surface roughness Rz of the grooves 15 was 3 μm or less; the jet velocity v was reduced by about 10% when the surface roughness Rz was 5 μm; and the jet velocity v was lowered by as much as 15% or more when the surface roughness Rz was 6.5 μm or more. Thus it was impossible, given relatively low levels of electric energy applied to the metal electrodes 13, to render the velocity of jetted ink droplets high enough to form characters and images onto the paper or like medium opposite to the ink jet printer head. It should take this type of ink jet apparatus a significantly high driving voltage to jet out ink droplets at sufficient velocities to form characters and images. That in turn requires building a large and complicated driving circuit that would place severe constraints on the effort to make the ink jet apparatus smaller in size and lower in manufacturing cost. The above deterioration in the jet velocity of ink droplets is thought to occur as follows. As the surface roughness Rz of the side walls becomes greater, the resistance to the ink flow from the manifold 22 through the ink chamber 12 to the nozzle 32 increases. This results in greater losses of electric energy applied to the metal electrodes 13.

Given the results above, the embodiment of FIG. 12 is alternatively constructed so that the surface roughness Rz of the side walls separating the grooves will be 6.5 μm or less and preferably 5 μm at most. This embodiment efficiently enhances the ink pressure inside the ink chambers 12. That is, using relatively low driving voltages, the embodiment keeps the velocity of jetted ink droplets sufficiently high and the volume thereof sufficiently large to form characters and images onto the printing medium. According to the invention, driving voltages of as low as 20 to 50 volts still provide ink droplet velocities of 3 to 8 m/s and ink volumes of 30 to 90 pl. With the driving circuit thus made smaller and simpler in structure, the entire ink jet apparatus incorporating it is also reduced in size and manufactured at a lower cost.

According to the invention described above, the ink pressure generated within the ink chambers is made significantly higher in the following cases: when the height of the side walls divided by the width thereof (H/B) is at least 2 and at most 9; when the taper value T of the side walls is at most 0.16; when the width of the side walls divided by the pitch thereof (B/Z) is at least 0.2 and at most 0.9; or when the direction of the height of the side walls is at an angle of 18 degrees at most relative to the direction of polarization of the side walls. The velocity at which ink droplets are jetted out is made appreciably higher when the curvature of the grooves is at least 5 millimeters, when the bottoms of the grooves having the linearly varying depths have an absolute taper value of 0.02 at most, or when the surface roughness of the side walls is 6.5 μm at most. Where the curvature of the bottoms of the side walls is at least 5 μm, the jetting of ink droplets is not stopped inadvertently, whereby the reliability of the apparatus is boosted.

As many apparently different embodiments of this invention may be made without departing from the spirit and scope thereof, it is to be understood that the invention as defined in the appended claims is not limited to the specific embodiments described above.

What is claimed is:

1. An ink jet printing apparatus comprising:

a first plate; and a second plate coupled to said first plate having a plurality of spaced side walls upstanding in a longitudinal direction and separated by grooves defining ink chambers, said second plate being polarized in a polarization direction and wherein an angle between said polarization direction and the longitudinal direction of said side walls is between at most 18° and 0° , said side walls having a height and a width and said grooves having a bottom and a width, wherein a ratio of said height of said side walls to said width of said side walls is in a range of 2 to 9 and wherein each of said side walls has a pitch defined by the sum of said width of said side wall and said width of said groove, and wherein a ratio of said width of said side wall to said pitch of said side wall is in a range of 0.2 to 0.9.

2. The ink jet printing apparatus of claim 1 wherein said range of said height to said width of said side walls is 2.5 to 8.

3. The ink jet printing apparatus of claim 1 wherein said bottom of each of said grooves merges into said respective side walls in a curve having a radius of curvature of at least 5 μm.

4. The ink jet printing apparatus of claim 1 wherein each of said side walls has a bottom width Bl and a top width Bu and an upward taper T, wherein said taper is defined by the expression (Bl–Bu)/H, with H being said height of said side wall, said taper being 0.16 or less.

5. The ink jet printing apparatus of claim 1 wherein each of said grooves has a nozzle end and a back end, said back end sloping upwardly into a shallow groove, said upward slope having a radius of curvature of at least 5 mm.

6. The ink jet printing apparatus of claim 1 wherein each of said grooves has a nozzle end and a back end and tapers toward said back end with a slope of 0.02 or less.

7. The ink jet printing apparatus of claim 1 wherein said side walls have a surface roughness of 6.5 μm or less.

8. An ink jet printing apparatus comprising:

a first plate;

a second plate coupled to said first plate having a plurality of spaced side walls upstanding in a longitudinal direction and separated by grooves defining ink chambers, said side walls having a height and a width and said grooves having a bottom and a width, wherein said bottom of each of said grooves merges into said respective side walls in a curve having a radius of curvature of at least 5 μm, wherein each of said side walls has a pitch defined by the sum of said width of said side wall and said width of said groove, and wherein a ratio of said width of said side wall to said pitch of said side wall is in a range of 0.2 to 0.9.

9. The ink jet printing apparatus of claim 8 wherein said ratio of said width of said side wall to said pitch of said side wall is in a range of 0.3 to 0.8.

10. The ink jet printing apparatus of claim 8 wherein said grooved plate is polarized in a polarization direction and an angle between said polarization direction and the longitudinal direction of said side walls is 18° or less.

11. The ink jet printing apparatus of claim 8 wherein each of said grooves has a nozzle end and a back end, said back end sloping upwardly into a shallow groove, said upward slope having a radius of curvature of at least 5 mm.

12. The ink jet printing apparatus of claim 8 wherein each of said grooves has a nozzle end and a back end and tapers toward said back end with a slope of 0.02 or less.

13. The ink jet printing apparatus of claim 8 wherein said side walls have a surface roughness of 6.5 μm or less.

14. The ink jet printing apparatus of claim 8, wherein each of said side walls has a bottom width Bl and a top width Bu and an upward taper T, wherein said taper is defined by the expression (Bl–Bu)/H, with H being said height of said side wall, said upward taper of each of said side walls being 0.16 or less.

15. An ink jet printing apparatus comprising:

a first plate;

a second plate coupled to said first plate having a plurality of spaced side walls upstanding in a longitudinal direction and separated by grooves defining ink chambers, said walls having a height and a width and said grooves having a bottom and a width, wherein said bottom of each of said grooves merges into said respective side walls in a curve having a radius of curvature of at least 5 μm.

16. The ink jet printing apparatus of claim 15 wherein said curve has a radius of curvature of at least 7 μm.

17. The ink jet printing apparatus of claim 15 wherein each of said side walls has a bottom width Bl and a top width Bu and an upward taper T, wherein said taper is defined by the expression (Bl–Bu)/H, with H being said height of said side wall, said taper being 0.16 or less.

18. The ink jet printing apparatus of claim 15 wherein said second plate is polarized in a polarization direction and an angle between said polarization direction and the longitudinal direction of said side walls is 18° or less.

19. The ink jet printing apparatus of claim 15 wherein each of said grooves has a nozzle end and a back end, said back end sloping upwardly into a shallow groove, said upward slope having a radius of curvature of at least 5 mm.

20. The ink jet printing apparatus of claim 15 wherein each of said grooves has a nozzle end and a back end and tapers toward said back end with a slope of 0.02 or less.

21. The ink jet printing apparatus of claim 15 wherein said side walls have a surface roughness of 6.5 μm or less.

22. An ink jet printing apparatus comprising:

a first plate;

a second plate coupled to said first plate having a plurality of spaced side walls upstanding in a longitudinal direction and separated by grooves defining ink chambers, said walls having a height and a width and said grooves having a bottom and a width, wherein each of said side walls has a bottom width Bl and a top width Bu and an upward taper T, wherein said taper is defined by the expression (Bl–Bu)/H, with H being said height of said side wall, said taper being 0.16 or less, and wherein said side walls have a surface roughness of 6.5 μm or less.

23. The ink jet printing apparatus of claim 22 wherein said taper is at most 0.1.

24. The ink jet printing apparatus of claim 22 wherein each of said side walls has an electrode coupled thereto, said electrode having a length and a ratio of said length of said electrode to said height of said side wall is 0.5.

25. The ink jet printing apparatus of claim 22 wherein said grooved plate is polarized in a polarization direction and an angle between said polarization direction and the longitudinal direction of said side walls is 18° or less.

26. The ink jet printing apparatus of claim 22 wherein each of said grooves has a nozzle end and a back end, said back end sloping upwardly into a shallow groove, said upward slope having a radius of curvature of at least 5 mm.

27. The ink jet printing apparatus of claim 22 wherein each of said grooves has a nozzle end and a back end and tapers toward said back end with a slope of 0.02 or less.

28. An ink jet printing apparatus comprising:

a first plate;

a second plate coupled to said first plate having a plurality of spaced side walls upstanding in a longitudinal direction and separated by grooves defining ink chambers, said walls having a height and a width and said grooves having a bottom and a width, wherein said second plate is polarized in a polarization direction and an angle between said polarization direction and the longitudinal direction of said side walls is between at most 18° and 0°.

29. The ink jet printing apparatus of claim 28 wherein said angle is 14° at most.

30. The ink jet printing apparatus of claim 28 wherein each of said grooves has a nozzle end and a back end, said back end sloping upwardly into a shallow groove, said upward slope having a radius of curvature of at least 5 mm.

31. The ink jet printing apparatus of claim 28 wherein each of said grooves has a nozzle end and a back end and tapers toward said back end with a slope of 0.02 or less.

32. The ink jet printing apparatus of claim 28 wherein said side walls have a surface roughness of 6.5 μm or less.

33. An ink jet printing apparatus comprising:

a first plate;

a second plate coupled to said first plate having a plurality of spaced side walls upstanding in a longitudinal direction and separated by grooves defining ink chambers, said walls having a height and a width and said grooves having a bottom and a width, wherein each of said grooves has a nozzle end and a back end, said back end sloping upwardly into a shallow groove, said upward slope having a radius of curvature of at least 5 mm, and wherein each of said grooves tapers toward said back end with a slope of between at most 0.02 and 0.

34. The ink jet printing apparatus of claim 33 wherein said upward slope has a radius of curvature of 7 mm or more.

35. The ink jet printing apparatus of claim 33 wherein said side walls have a surface roughness of 6.5 μm or less.

36. An ink jet printing apparatus comprising:

a first plate;

a second plate coupled to said first plate having a plurality of spaced side walls upstanding in a longitudinal direction and separated by grooves defining ink chambers, said walls having a height and a width and said grooves having a bottom and a width, wherein each of said grooves has a nozzle end and a back end and tapers toward said back end with a slope of between at most 0.02 and 0.

37. The ink jet printing apparatus of claim 36 wherein said groove tapers with a slope of 0.012 at most.

38. The ink jet printing apparatus of claim 36 wherein said side walls have a surface roughness of 6.5 μm or less.

39. An ink jet printing apparatus comprising:

a first plate;

a second plate coupled to said first plate having a plurality of spaced side walls upstanding in a longitudinal direction and separated by grooves defining ink chambers, said walls having a height and a width and said grooves having a bottom and a width, wherein said side walls have a surface roughness of 6.5 μm or less.

40. The ink jet printing apparatus of claim 39 wherein said botto of each of said grooves merges into-said respective side walls in a curve having a radius of curvature of at least 5 μm, each of said grooves has a nozzle end and a back end, said back end sloping upwardly into a shallow groove, said upward slope having a radius of curvature of at least 5 mm, and each of said grooves has a nozzle end and a back end and tapers toward said back end with a slope of 0.02 or less.

41. The ink jet printing apparatus of claim 40 wherein a ratio of said height of said side walls to said width of said side walls is in a range of 2 to 9, each of said side walls has a pitch defined by the sum of said width of said side wall and said width of said groove, wherein a ratio of said width of said side wall to said pitch of said side wall is in a range of 0.2 to 0.9, and each of said side walls has a bottom width Bl and a top width Bu and an upward taper T, wherein said taper is defined by the expression (Bl–Bu)/H, with H being said height of said side wall, said taper being 0.16 or less.

42. The ink jet printing apparatus of claim 41 wherein said second plate is polarized in a polarization direction and an angle between said polarization direction and the longitudinal direction of said side walls is 18° or less.

* * * * *